United States Patent [19]

Dolan et al.

[11] 4,421,636

[45] Dec. 20, 1983

[54] INERT GAS ENRICHMENT IN FCC UNIT REGENERATORS

[75] Inventors: Michael J. Dolan, Laurel Springs; Stephen J. McGovern, Deptford; Peter J. Owens, West Deptford, all of N.J.

[73] Assignee: Mobil Oil Corporation, New York, N.Y.

[21] Appl. No.: 366,951

[22] Filed: Apr. 9, 1982

Related U.S. Application Data

[63] Continuation-in-part of Ser. No. 298,404, Sep. 1, 1981, Pat. No. 4,395,325.

[51] Int. Cl.[3] ..... C10G 11/18; B01J 37/14

[52] U.S. Cl. ..... 208/113; 208/163; 502/41

[58] Field of Search ..... 208/164, 163, 113; 252/419, 417

[56] References Cited

U.S. PATENT DOCUMENTS

| | | | |
|---|---|---|---|
| 2,476,144 | 7/1949 | Gullette | 208/164 X |
| 2,684,931 | 7/1954 | Berg | 208/164 X |
| 2,758,068 | 8/1956 | Howard | 208/164 |
| 2,985,584 | 5/1961 | Rabo et al. | 208/120 |
| 4,007,131 | 2/1977 | Gillespie et al. | 252/419 |
| 4,211,636 | 7/1980 | Gross et al. | 208/164 |
| 4,235,704 | 11/1980 | Luckenbach | 208/113 |
| 4,260,518 | 4/1981 | Katzer et al. | 252/411 S |

FOREIGN PATENT DOCUMENTS

| | | | |
|---|---|---|---|
| 854166 | 10/1970 | Canada | 208/164 |

*Primary Examiner*—Curtis R. Davis
*Assistant Examiner*—O. Chaudhuri
*Attorney, Agent, or Firm*—Charles A. Huggett; Charles J. Speciale; Stanislaus Aksman

[57] ABSTRACT

The concentration of sulfur trioxides in an FCC unit regenerator is maintained within environmentally accepted limits, while maintaining an adequate amount of gas for fluidizing conditions in the regenerator, by admixing the regenerator oxygen-containing gas with an inert gas. The quantity of the inert gas is controlled by a control loop measuring the pressure drop in the regenerator, and adjusting the amount of the inert gas to maintain the pressure drop within the predetermined limits.

12 Claims, 2 Drawing Figures

SILICONE EMULSIFIER COMPOSITION, INVERT EMULSIONS THEREFROM AND METHOD THEREFOR

BACKGROUND OF THE INVENTION

The present invention relates to invert emulsions for the well-drilling industry, to a method for their preparation and to an emulsifier composition useful therein. More particularly, the present invention relates to improved emulsions of a brine in a liquid hydrocarbon, and further comprising an improved silicone emulsifier composition, which are useful in well-drilling operations, such as in gas- and/or oil-well drilling, as a drilling fluid, a completion fluid, a workover fluid, a casing pack fluid, a fracturing fluid, a packer fluid and a spacer fluid.

Invert emulsions, in the form of drilling muds, completion fluids and packer fluids are well known in the well-drilling art. Invert emulsions typically consist of a fluid phase comprising from 15 to 45 percent by volume of a $CaCl_2$ brine and 55 to 85 percent by volume of diesel oil, and a solid phase comprising agents for pressure control, filtration control, viscosity control, gelling, etc. An invert emulsion drilling mud generally contains from 5 to 30 percent by volume of the brine.

While conventional invert emulsions are used in drilling deep wells, where high temperature and pressure are commonly encountered, they are not completely satisfactory for such a use. For example, invert emulsions are sometimes not sufficiently stable at the high temperatures encountered in deep wells. Furthermore, the use of large amounts of a weighting agent in an invert emulsion to achieve pressure control in deep wells is often undesirable because the permeability of the producing zone can be adversely affected. Heavier brines, such as brines containing $CaBr_2$ and/or $ZnBr_2$, have been used to increase the density of silicone-free invert emulsions, thereby achieving greater pressure control; however, the stability of these heavier emulsions is marginal or non-existent at high temperature.

Thermally stable invert emulsions comprising a brine, a liquid hydrocarbon and a polydiorganosiloxane have been disclosed by Romenesko et al., U.S. Pat. No. 236,968, filed on Feb. 23, 1981 and assigned to the assignee of this invention. While the invert emulsions of Romenesko et al. constitute a significant advance in the art, some of them do not possess a high degree of thermal stability unless they are thickened with conventional thickening agents. In particular, the solids-free invert emulsions of Romenesko et al. comprising a heavy brine of $CaBr_2$ and $ZnBr_2$ seem to degrade at high temperature, apparently because HBr, which is produced by the heavy brine at high temperature, degrades the polydiorganosiloxane emulsifier. Invert emulsions, and particularly solids-free emulsions, comprising a heavy brine and having greater stability in downhole conditions are therefore still needed.

BRIEF SUMMARY OF THE INVENTION

It is an object of this invention to provide an improved invert emulsion which is suitable for use in the well-drilling industry. It is another object of this invention to provide solids-free invert emulsions of a high density brine which have stability at high temperatures and pressures. It is another object of this invention to provide stable, solids-free invert emulsions having high density and being suitable for use in a deep-well drilling.

It is also an object of this invention to provide a method for preparing the invert emulsions of this invention. It is yet another object of this invention to provide a silicone emulsifier composition which is useful for preparing improved invert emulsions.

These objects, and others which will become obvious after considering the following disclosure and appended claims, are obtained by the present invention which comprises emulsifying a brine in a liquid hydrocarbon containing an emulsifier composition comprising certain polydiorganosiloxane surface active agents and certain organopolysiloxane resins. According to this invention it is possible not only to prepare a solids-free, thermally stable emulsion of a high density brine but also to prepare a stable emulsion comprising a fluid phase having a major amount of a high density brine and a minor amount of a liquid hydrocarbon. The resulting invert emulsions are sufficiently dense to permit their use as a solids-free completion fluid in deep-well drilling; some of them can also be formulated to contain solid and/or liquid components which are commonly used in the well-drilling art for various purposes, such as for preparing invert emulsion drilling muds.

While not intending to be limited by theory we believe that the present invention provides improved brine-in-liquid hydrocarbon emulsions because the organopolysiloxane resin copolymer component acts to protect the polydiorganosiloxane surface active component from the degrading action of acidic materials, such as HBr, which are produced by the brine at high temperature, and thereby provides improved emulsion stability.

DETAILED DESCRIPTION OF THE INVENTION

Figure 1:
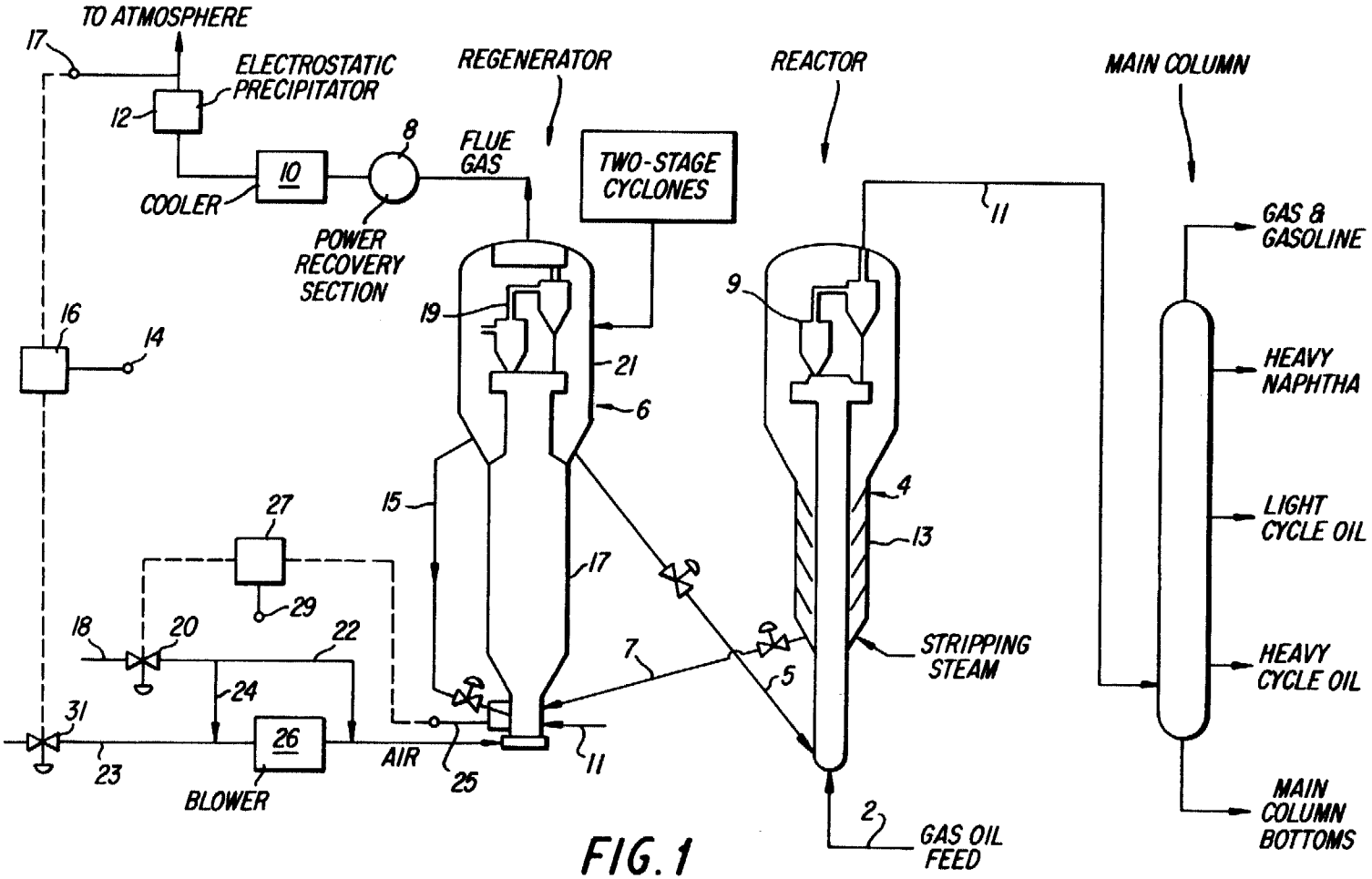

In one aspect the present invention relates to an emulsifier composition, optionally containing an organic solvent, said emulsifier composition consisting essentially of (a) from 30 to 90 percent by weight of a polydiorganosiloxane having the formula $Z_3SiO\{(CH_3)_2SiO\}_x\{(CH_3)(R)SiO\}_y\{(CH_3)(Q)SiO\}_zSiZ_3$ wherein Q denotes a polyoxyalkylene radical having the formula $-R'O(CH_2CH_2O)_p(CH_2CHCH_3O)_qR''$, R denotes a monovalent hydrocarbon radical having from 6 to 18 carbon atoms, inclusive, R' denotes a divalent organic radical bonded to a silicon atom by a silicon-carbon bond, R'' denotes a monovalent radical selected from the group consisting of hydrogen, alkyl, cycloaliphatic, aryl, arylalkyl and acyl radicals, Z denotes a monovalent hydrocarbon radical having from 1 to 5 carbon atoms, inclusive, or a Q radical, or an R radical, x has an average value of from 0 to 400, y has an average value of from 0 to 400, z has an average value of from 0 to 5, $x+y+z$ has an average value of from 30 to 400, p has an average value equal to or greater than the average value of q and $p+q$ has an average value sufficient to provide a formula weight of from 600 to 3500 for the $-(CH_2CH_2O)_p(CH_2CHCH_3O)_q-$portion of the Q radical, there being an average of at least one Q radical and an average of at least one R radical per molecule of the polydiorganosiloxane, and (b) from 10 to 70 percent by weight of a solid benzene-soluble organopolysiloxane resin copolymer consisting essentially of $(CH_3)_3SiO_{1/2}$ siloxane units and $SiO_{4/2}$ siloxane units, there being from 0.6 to 0.9, inclusive, of said $(CH_3)_3SiO_{1/2}$ siloxane units for every $SiO_{4/2}$ siloxane unit.

In another aspect the present invention relates to an emulsion composition comprising (A) from 40 to 75 parts by volume of a brine as a discontinuous phase, (B) from 25 to 60 parts by volume of a liquid hydrocarbon selected from the group consisting of paraffins having a flash point of at least 100° F., kerosene, diesel oil, crude oil, turbine fuel, mineral oil and gas oil as a continuous phase, (A) and (B) totaling 100 parts by volume and 100 parts by weight, and (C) from 1.0 to 10 parts by weight, for every 100 parts by weight of brine plus liquid hydrocarbon, of an emulsifier composition consisting essentially of from 30 to 90 percent by weight of (a) a polydiorganosiloxane having the formula $$Z_3SiO\{(CH_3)_2SiO\}_x\{(CH_3)(R)SiO\}_y\{(CH_3)(Q)SiO\}_zSiZ_3,$$

wherein Q denotes a polyoxyalkylene radical having the formula $-R'O(CH_2CH_2O)_p(CH_2CHCH_3O)_qR''$, R denotes a monovalent hydrocarbon radical having from 6 to 18 carbon atoms, inclusive, R' denotes a divalent organic radical bonded to a silicon atom by a silicon-carbon bond, R'' denotes a monovalent radical selected from the group consisting of hydrogen, alkyl, cycloaliphatic, aryl, arylalkyl and acyl radicals, Z denotes a monovalent hydrocarbon radical having from 1 to 5 carbon atoms, inclusive, or an R radical or a Q radical, x has an average value of from 0 to 400, y has an average value of from 0 to 400, z has an average value of from 0 to 5, x+y+z has an average value of from 30 to 400, p has an average value equal to or greater than the average value of q and p+q has an average value sufficient to provide a formula weight of from 600 to 3500 for the $-(CH_2CH_2O)_p(CH_2CHCH_3O)_q-$portion of the Q radical, there being an average of at least one Q radical and an average of at least one R radical per molecule of the polydiorganosiloxane, and (b) from 10 to 70 percent by weight of a solid, benzene-soluble organopolysiloxane resin copolymer consisting essentially of $(CH_3)_3SiO_{\frac{1}{2}}$ siloxane units and $SiO_{4/2}$ siloxane units, there being from 0.6 to 0.9, inclusive, of said $(CH_3)_3SiO_{\frac{1}{2}}$ siloxane units for every $SiO_{4/2}$ siloxane unit.

The present invention further relates to a method for preparing the emulsion compositions of this invention comprising (I) mixing to form a solution, (i) 1.0 to 10 parts by weight of an emulsifier composition consisting essentially of (a) from 30 to 90 percent by weight of a polydiorganosiloxane having the formula $$Z_3SiO\{(CH_3)_2SiO\}_x\{(CH_3)(R)SiO\}_y\{(CH_3)(Q)SiO\}_zSiZ_3$$

wherein Q denotes a polyoxyalkylene radical having the formula $-R'O(CH_2CH_2O)_p(CH_2CHCH_3O)_qR''$, R denotes a monovalent hydrocarbon radical having an average of from 6 to 18 carbon atoms, inclusive, R' denotes a divalent organic radical bonded to a silicon atom by a silicon-carbon bond, R'' denotes a monovalent radical selected from the group consisting of hydrogen, alkyl, cycloaliphatic, aryl, arylalkyl and acyl radicals, Z denotes a monovalent hydrocarbon radical having from 1 to 5 carbon atoms, inclusive, or an R radical or a Q radical, x has an average value of from 0 to 400, y has an average value of from 0 to 400, z has an average value of from 0 to 5, x+y+z has an average value of from 30 to 400, p has an average value equal to or greater than the average value of q and p+q has an average value sufficient to provide a formula weight of from 600 to 3500 for the $-(CH_2CH_2O)_p(CH_2CHCH_3O)_q-$portion of the Q radical, there being an average of at least one Q radical and an average of at least one R radical per molecule of the polydiorganosiloxane, and (b) from 10 to 70 percent by weight of a solid, benzene-soluble organopolysiloxane resin copolymer consisting essentially of $(CH_3)_3SiO_{\frac{1}{2}}$ siloxane units and $SiO_{4/2}$ siloxane units, there being from 0.6 to 0.9, inclusive, of said $(CH_3)_3SiO_{\frac{1}{2}}$ siloxane unit for every $SiO_{4/2}$ siloxane unit, and (ii) aV parts by volume of a liquid hydrocarbon selected from the group consisting of paraffins having a flash point of at least 100° F., kerosene, diesel oil, crude oil, turbine fuel, mineral oil and gas oil, (II) mixing the solution of step (I) with bV parts by volume of a liquid hydrocarbon selected from the group stated in (ii), (III) mixing V' part by volume of a brine with the solution of step (II) with sufficient shear energy to provide an emulsion having a brine particle size of less than 10 micrometers in diameter, and (IV) mixing the emulsion of step (III) with cV parts by volume of a liquid hydrocarbon selected from the group stated in (ii), wherein V has a value of from 25 to 60 parts by volume, a has a value of from greater than zero to 1, b has a value of from zero to less than 1, c has a value of from zero to less than 1, a plus b plus c has a value of 1, V' has a value of from 40 to 75 parts by volume and V plus V' totals 100 parts by weight and 100 parts by volume.

The discontinuous phase of the emulsion compositions of this invention is a brine. Herein, the term brine is used in its broadest sense, i.e. an aqueous solution of a salt containing at least 3 percent by weight of the salt. Preferably the brine is an aqueous solution of the salt, saturated at 20° C. The term brine further includes brine occuring naturally or brine prepared synthetically. It is within the scope and spirit of this invention to dissolve one or more salts in natural brine to prepare a brine suitable for use in the emulsions of this invention.

The salt portion of the brine preferably has a high solubility in water at room temperature so that the emulsion compositions of this invention can be formulated to have a wide range of densities. The salt advantageously has, in addition to a high solubility in water, a large formula weight so that the brine can be formulated to have a high density, for example up to 22 pounds per gallon (2642 kilograms per cubic meter).

Salts being suitable for use in the emulsions of this invention, include sodium chloride, sodium carbonate, potassium chloride, potassium carbonate, calcium chloride, calcium bromide, zinc chloride, zinc bromide and mixtures thereof.

Conveniently, a suitable brine for the emulsions of this invention can comprise the natural brine, optionally mixed with a salt, that is frequently present at the drilling site where these emulsions are used. The present invention contemplates the storing of the other components of these emulsions, hereinafter delineated, at the drilling site as separate and/or mixed components and formulating the emulsions of this invention in-the-field, as desired.

A preferred brine in the emulsion compositions of this invention comprises water saturated with a mixture of calcium bromide and zinc bromide and having a density of about 20 pounds per gallon at 20° C. Such a heavy brine can be emulsified in a liquid hydrocarbon according to this invention to provide an emulsion that needs no additional weighting agent, such as barium sulfate, to permit its use as a completion fluid in petroleum- and/or gas-well drillings. Advantageously, the heavy brine The invention will now be described in conjunction with two exemplary embodiments thereof illustrated in the FIGURES.

Referring to FIG. 1, a gas oil feed is introduced through a conduit 2 into a riser reactor 4 along with a regenerated catalyst conducted to the reactor from the regenerator 6 by a conduit 5. The feed volatilizes almost instantaneously, and it forms a suspension with the catalyst which proceeds upwardly in the riser. The suspension then passes into a generally wider section of the reactor which contains solid-vapor separation means 9, such as conventional cyclones. The catalyst is separated from the products of the reaction, and is then conducted to a stripping section 13, wherein entrained gases are removed from the catalyst by steam.

Stripped catalyst containing carbonaceous deposits (i.e., coke) is withdrawn from the bottom of the stripping section through a conduit 7 and conducted to a regeneration zone or vessel 6. In the regeneration zone, the catalyst undergoes preliminary regeneration in a relatively narrow combustion zone 11 by passing oxygen-containing gas, such as air, into the combustion zone and burning the coke off the catalyst. The catalyst suspension then proceeds into a relatively wider section 17 of the regenerator, wherein residual carbon and CO are combusted, and, finally, into a solids-gas separation section 21 containing separation means, e.g., cyclones, 19. In the separation section 21, the catalyst is separated from the flue gas. The flue gas is then conducted to an optional power recovery section 8, then to a cooler 10, and finally to an electrostatic precipitator 12 before it is discharged into the atmosphere. Inert gas, e.g, nitrogen, can be optionally supplied to the regenerator by a conduit 18 equipped with a valve 20. The inert gas may be admixed with the oxygen-containing regeneration gas, e.g., air, by a conduit 24, before the regeneration gas is introduced into a blower 26, or through a conduit 22 after the regeneration gas is discharged from the blower 26. The amount of the inert gas admixed with the air is regulated by a control loop comprising a pressure sensor 25, a controller 27 and a valve 20. The pressure sensor 25 measures the pressure drop in the combustor section 11, and relays this information to the controller 27, equipped with a setpoint 29. The controller 27 also controls the operation and the degree of opening of the valve 20. The pressure sensor 25 measures the pressure drop in the combustor section across a distance of 62.4 inches. The measured value of the pressure differential across that distance corresponds directly to apparent density of the catalyst bed in the combustor section. Thus, optimum pressure differential across the 62.4 inches vertical distance in the combustor section is 14–16 inches of water, corresponding to an apparent catalyst density of 14–16 pounds per cubic foot ($lb/ft^3$). If the pressure differential detected by the sensor 25, and thus the apparent catalyst density, exceeds tht level, thereby indicating an excessive amount of inert gas introduced into the regenerator, controller 27 decreases the opening of the valve 20 to decrease the deviation between the optimum pressure differential value and the measured value. Conversely, if the measured pressure differential value is lower than the optimum value, controller 27 increases the opening of the valve 20 to introduce more inert gas into the regenerator to maintain the fluidized catalyst bed at the desired density. Accordingly, the deviation (defined as the difference between the measured pressure differential value and the preset value) is decreased.

The amount of the oxygen-containing regeneration gas (air in this example) is controlled by a controller 16, having a set point 14. The amount of the air introduced into the regenerator is controlled by valve 31, which is controlled by the controller 16 in response to the oxygen concentration in the flue gas monitored by an oxygen sensor 17. The optimum amount of oxygen ($O_2$) concentration in the flue gas is set in the setpoint 14 at about about 0 to about 1 mole percent, preferably about 0 to about 0.7 mole percent, and most preferably about 0 to about 0.5 mole percent. Control of the flue gas oxygen content within the aforementioned limits enables operator of the process to keep the $SO_3$ emissions at such a level that the molar ratio of $SO_3/SO_x$ is less than 5 percent. If the concentration of $O_2$ detected by the detector 17 in the flue gas exceeds the level set at the setpoint 14, thereby indicating an excessive amount of oxygen being introduced into the regeneration zone, controller 16 decreases the opening of the valve 20 to decrease the intake of air into the regenerator. Accordingly, the concentration of oxygen in the regenerator will decrease, and so will the concentration of $SO_3$ in the flue gas. Conversely, if the concentration of oxygen detected by the detector 17 is less than the limit set in the setpoint 14, the controller 16 sends a signal to valve 20 to increase the opening thereof, thereby increasing the intake of air into the regenerator. Valve 20 may also be commonly controlled by operator intervention to control the rate of air flow, and thus the $SO_3$ content of the flue gas. However, it is preferred to operate the valve 20 by means of an automatic control loop described above.

Figure 2:
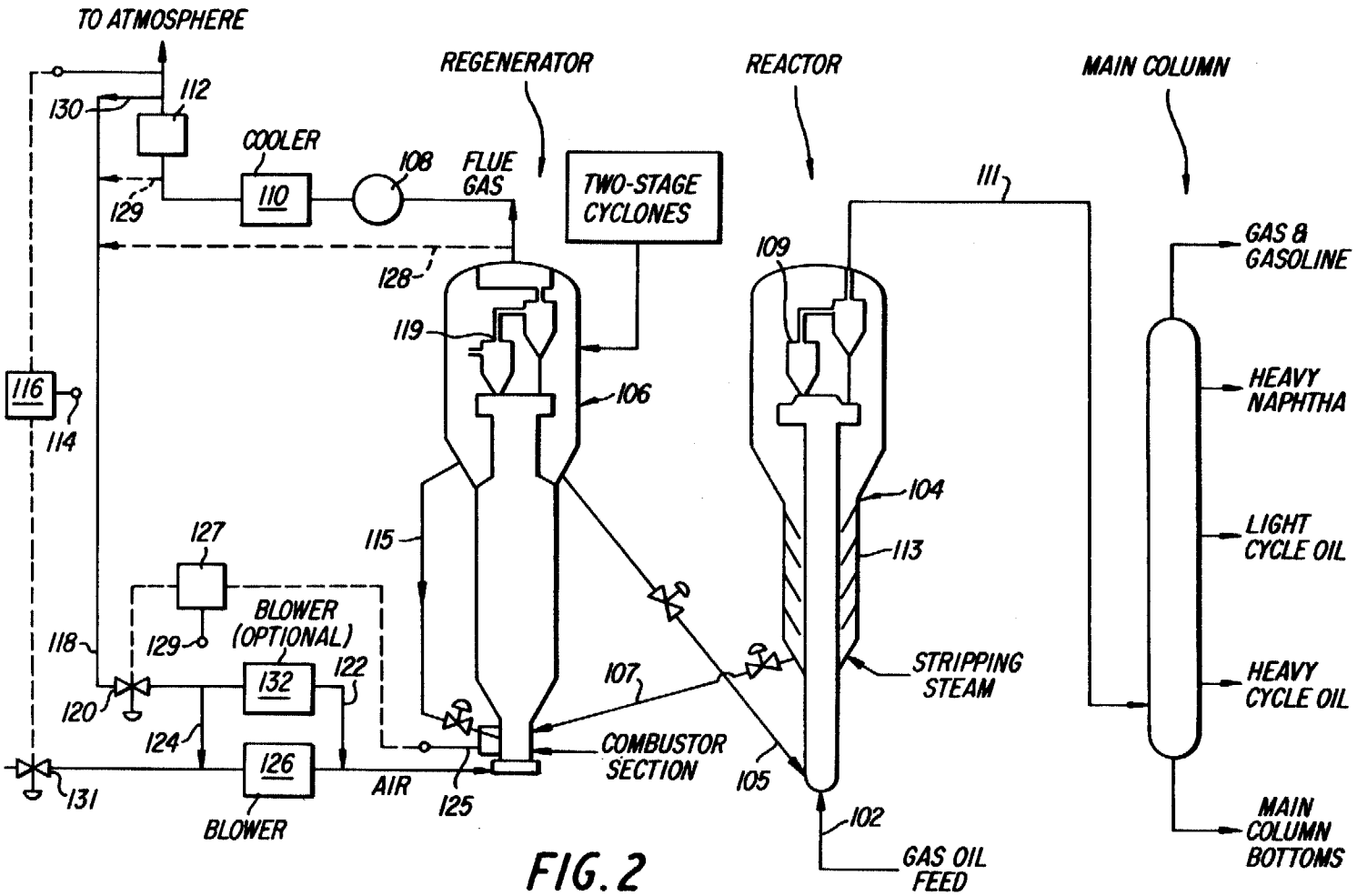

In an alternative embodiment, illustrated in FIG. 2, the inert gas admixed with air (or any other oxygen-containing gas) is recycled flue gas. The flue gas may be recycled from three different alternative positions shown in the drawing and discussed in detail below.

The operation of the reactor and the regenerator section of the apparatus of the embodiment of FIG. 2 is identical to that of the embodiment shown in FIG. 1, discussed above. The respective parts of the apparatus of FIG. 2 are numbered identically to those of the embodiment of FIG. 1, with a prefix of 100. Thus, for example, the gas oil feed line 102 of FIG. 2 corresponds to the gas oil feed line 2, and the riser reactor 104 of FIG. 2 corresponds to that of the riser reactor 4 of FIG. 1. Accordingly, it is believed that the operation of the respective parts of the embodiment of FIG. 2 will be obvious to those skilled in the art from the above description of the embodiment of FIG. 1. Flue gas is recycled in this embodiment from the exit of the regenerator vessel to the conduit 123 carrying oxygen-containing regeneration gas. The flue gas may be recycled into the conduit 123 from one of three different locations shown in FIG. 2. Thus, the flue gas may be recycled from the outlet of the regenerator cyclone separation system via line 128 (shown as a phantom line in FIG. 2) to the suction side of the combustion air blower 126. If the flue gas is recycled directly from the outlet of the cyclone separation system, it provides a high pressure, relatively high temperature gas with a relatively high catalyst fines content.

Alternatively, the recycle flue gas may be recycled from the inlet of the electrostatic precipitator through a conduit 129 (also shown as a phantom line in FIG. 2) to the intake side of blower 126. In this embodiment, the recycled gas has lower temperature than that recycled through a conduit 128, because it passed through a power recovery section 108 and a cooler 110.

In yet another embodiment, the recycled flue gas may be recycled from the outlet of the electrostatic precipitator 112 through a conduit 130 to the blower 126. In this case, the recycled flue gas also has a relatively low temperature and a relatively low solids catalyst fines content because of its passage through the electrostatic precipitator. The proper source for the recycled flue gas may be chosen by an individual operator based on individual unit economics. However, as mentioned above, the recycle of the flue gas from any of the three aforementioned points in the process aids in the reduction of the emission of oxides of sulfur ($SO_x$) from the regenerator. Repeated contact of the $SO_x$ from the flue gas with the catalyst increases the driving force for the $SO_x$ capture onto the catalyst which, eventually, is returned to the riser of the reactor, wherein the $SO_x$ is released as hydrogen sulfide.

An optional blower 132 may be placed in the flue recycle line 122 in order to increase, if needed, the capacity of the main blower 126. It will be obvious to those skilled in the art that the control of the amount of flue gas admixed with the oxygen-containing regeneration gas is accomplished in the same manner as in the embodiment of FIG. 1 by a control loop comprising a controller 127 with a setpoint 129, a pressure sensor 125 and a valve 120 controlled by the controller 127.

It will also be obvious to those skilled in the art that the catalytic cracking process and apparatus of this invention may be conventionally equipped with a number of other control loops normally used in catalytic cracking installations, and the operation of these conventional loops can be integrated and/or can be kept independent of the operation of the control loops discussed above. Such conventionally used control loops, and other details of FCC processes, are fully disclosed in the following patents and publications: U.S. Pat. Nos. 2,383,636 (Wurth); 2,689,210 (Leffer); 3,338,821 (Moyer et al); 3,812,029 (Snyder, Jr.); 4,093,537 (Gross et al); 4,118,338 (Gross et al); Venuto et al, *Fluid Catalytic Cracking with Zeolite Catalysts*, Marcel Dekher Inc. (1979). The entire contents of all of the above patents and publications are incorporated herein by reference.

It will be apparent to those skilled in the art that the above general description of the apparatus, the process and of the specific embodiments thereof can be successfully repeated with apparatus and ingredients equivalent to those generically or specifically set forth above and under variable process conditions.

From the foregoing specification, one skilled in the art can readily ascertain the essential features of this invention and without departing from the spirit and scope thereof can adopt it to various diverse applications.

We claim:

1. In a catalytic cracking process comprising:

contacting a hydrocarbonaceous feed with a cracking catalyst to produce cracked hydrocarbon vapors and deactivated catalyst containing carbonaceous deposits;

separating the deactivated catalyst from the hydrocarbon vapors and conducting the deactivated catalyst to a regeneration vessel;

regenerating the deactivated catalyst under fluidized bed conditions in the regeneration vessel by means of an oxygen-containing gas introduced into the regeneration vessel, thereby forming a flue gas comprising oxygen, sulfur dioxide, sulfur trioxide, carbon monoxide and carbon dioxide;

the improvement wherein the oxygen-containing gas is admixed with a stream of an inert gas, prior to the introduction of the oxygen-containing gas into the regeneration vessel, in the amount sufficient to maintain apparent catalyst bed density in the regeneration vessel at about 10 to about 30 lbs/ft$^3$ and the amount of the oxygen content in the flue gas at about 0 to about 1 mole percent.

2. A process according to claim 1 wherein the inert gas comprises the regeneration vessel flue gas.

3. A process according to claim 2 wherein the regeneration vessel flue gas is conducted through a regeneration vessel cyclone separation system before being admixed with the oxygen-containing gas.

4. A process according to claim 3 wherein the regeneration vessel flue gas, after passing through the regeneration vessel cyclone separation system, is conducted through an electrostatic precipitator.

5. A process according to claim 1 wherein the inert gas is nitrogen.

6. A process according to claims 1, 2, 3, 4 or 5 further comprising a method for controlling the oxygen content of said flue gas, which comprises comparing the oxygen content of the flue gas with a predetermined value of the oxygen content to obtain an oxygen content deviation, and controlling the amount of the oxygen-containing gas in a direction to reduce the oxygen content deviation.

7. A process according to claim 6 further comprising a method for controlling apparent density of the fluidized catalyst bed in the regeneration vessel, which comprises comparing pressure drop in the fluidized catalyst bed in the regeneration vessel with a predetermined value of the pressure drop to obtain the pressure drop deviation, and controlling the amount of the inert gas admixed with the oxygen-containing gas in a direction to reduce the pressure drop deviation.

8. A process according to claim 7 wherein apparent catalyst bed density in the regeneration vessel is about 12 to about 20 lbs/ft$^3$.

9. A process according to claim 8 wherein apparent catalyst bed density in the regeneration vessel is about 14 to about 16 lbs/ft$^3$.

10. A process according to claim 6 wherein the predetermined value of the oxygen content of the flue gas is about 0 to about 0.7 mole percent.

11. A process according to claim 10 wherein the predetermined value of the oxygen content of the flue gas is about 0 to about 0.5 mole percent.

12. A process according to claim 11 wherein the $SO_3$ emissions in the flue gas are maintained at such a level that the molar ratio of $SO_3/SO_x$ is less than 5 percent.

* * * * *